United States Patent [19]

Jumer

[11] 4,190,513

[45] Feb. 26, 1980

[54] APPARATUS FOR CONTAINERLESS PORTABLE ELECTRO-POLISHING

[76] Inventor: John F. Jumer, 161 W. 131 Timber Trails Dr., Oak Brook, Ill. 60521

[21] Appl. No.: 943,371

[22] Filed: Sep. 18, 1978

[51] Int. Cl.[2] ..... C25F 3/16; C25F 7/00

[52] U.S. Cl. ..... 204/224 R; 204/129.6

[58] Field of Search ..... 209/224 R, 212

[56] References Cited

U.S. PATENT DOCUMENTS

| | | | |
|---|---|---|---|
| 2,146,924 | 2/1939 | Adey | 204/224 R |
| 2,539,455 | 1/1951 | Mazia | 204/224 R |
| 2,540,602 | 2/1951 | Thomas et al. | 204/224 R |
| 2,961,395 | 11/1960 | Icxi | 204/224 R |
| 4,001,094 | 1/1977 | Jumer | 204/224 R |

*Primary Examiner*—T. M. Tufariello

*Attorney, Agent, or Firm*—Lockwood, Dewey, Alex & Cummings

[57] ABSTRACT

A method and apparatus for electro-polishing surfaces of metal objects, which is immersionless and containerless, includes a simplified frame, a cathode mounted on the frame and adapted to be positioned a predetermined distance from the surface to be polished, and a sheet of liquid-retaining material positioned between the cathode and the surface to be polished. When the cathode is negatively charged, the anode is positively charged, and electrolytic bath is introduced to the liquid-retaining material, a circuit is completed between the cathode and anode and an electro-polishing action takes place on the anode. This material retains the electrolyte and allows the gases generated to escape. Various portable adaptations of the invention enhance its use for specific polishing operations.

14 Claims, 11 Drawing Figures

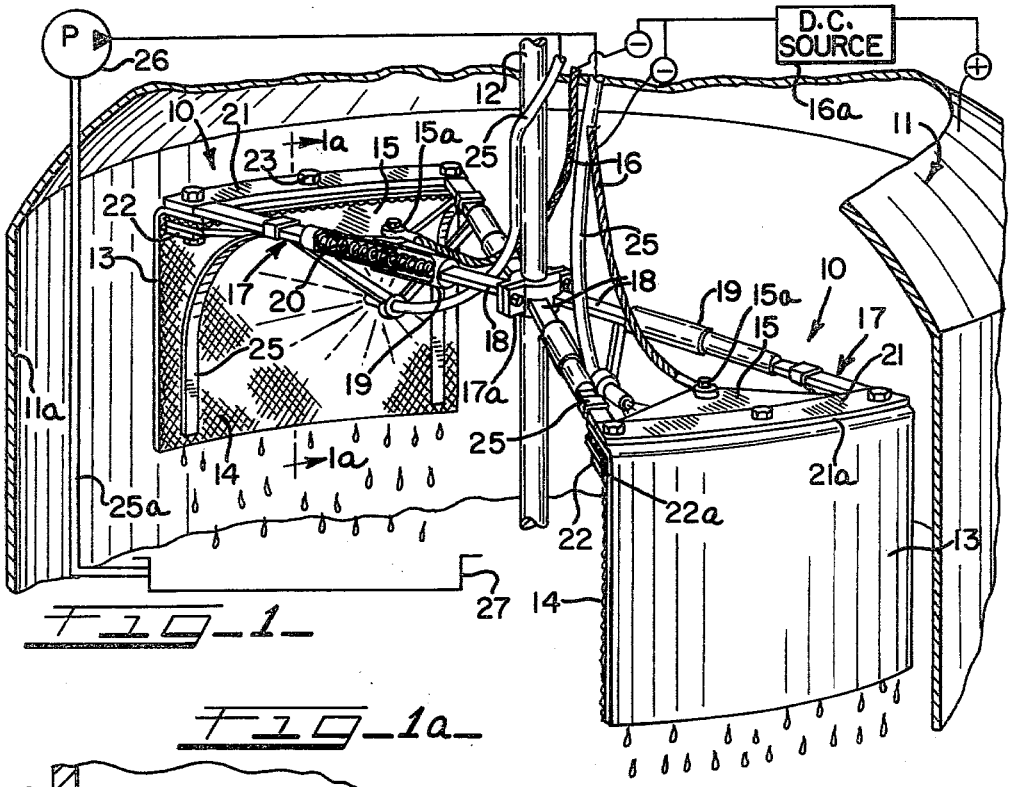
FIG. 1
FIG. 1a
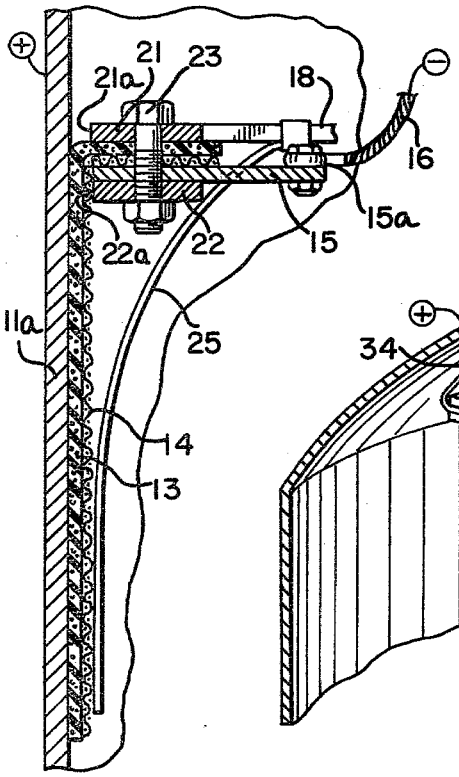
FIG. 2
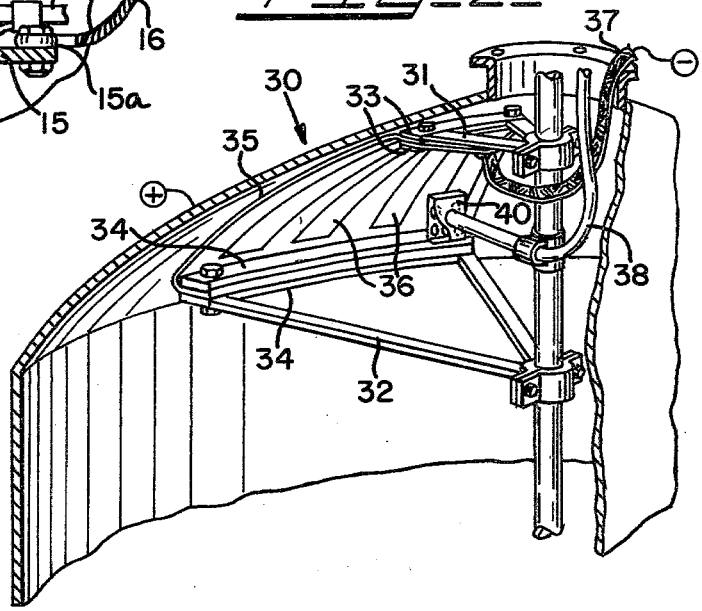

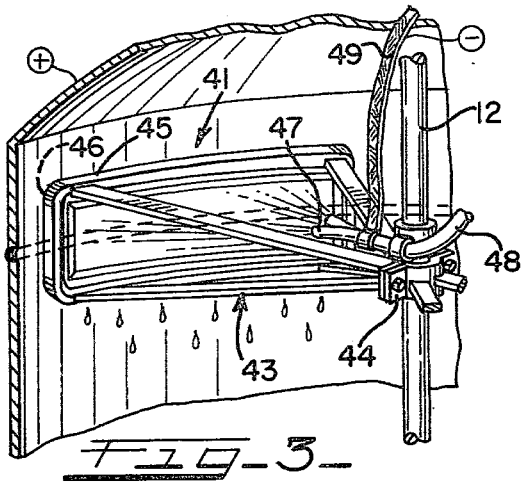
FIG. 3
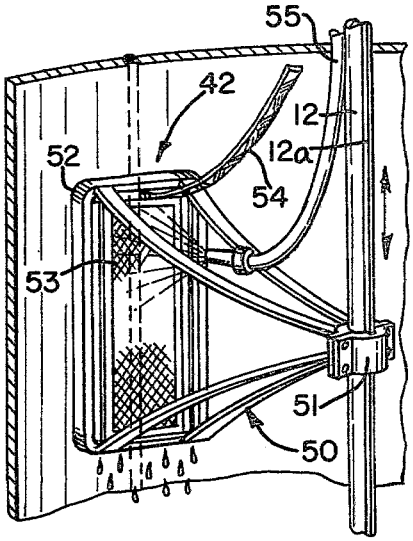
FIG. 3a
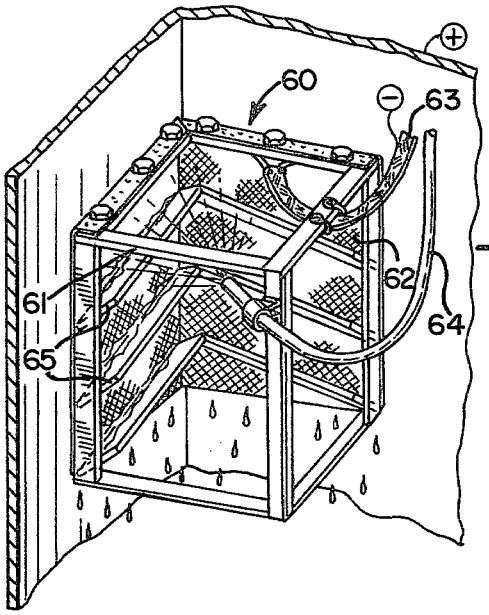
FIG. 4
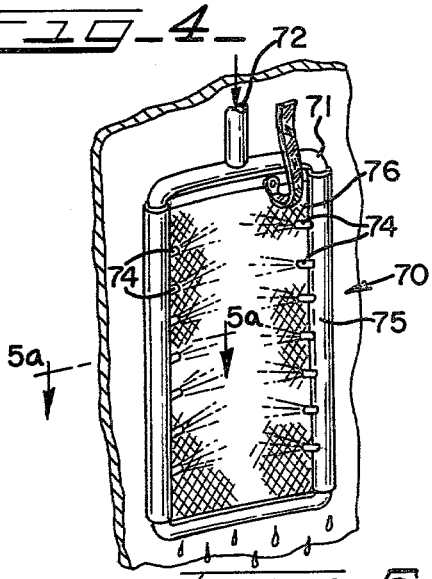
FIG. 5
FIG. 5a
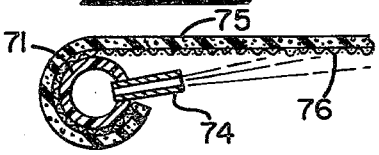

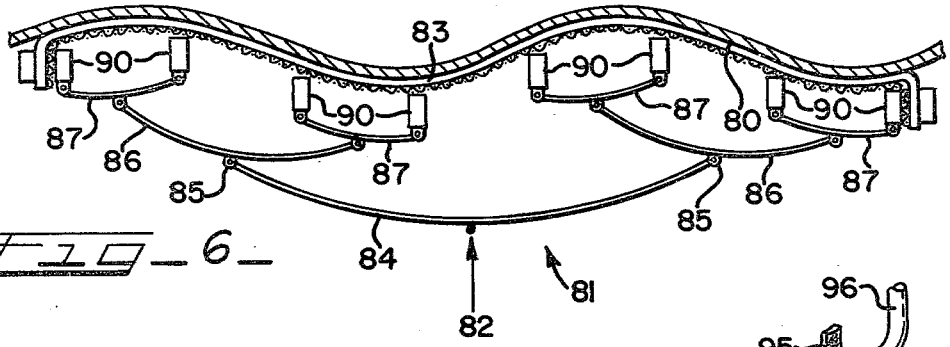
FIG. 6
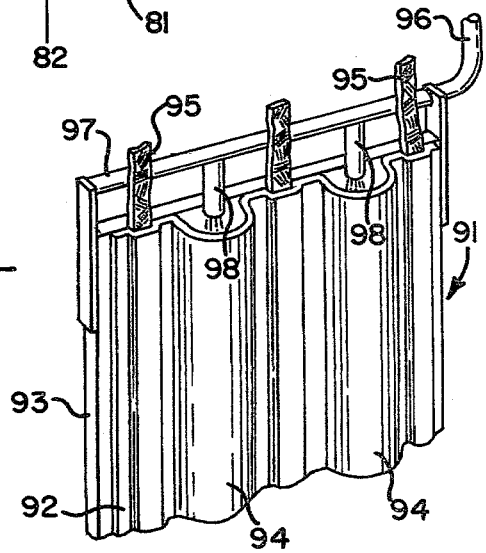
FIG. 7
FIG. 8
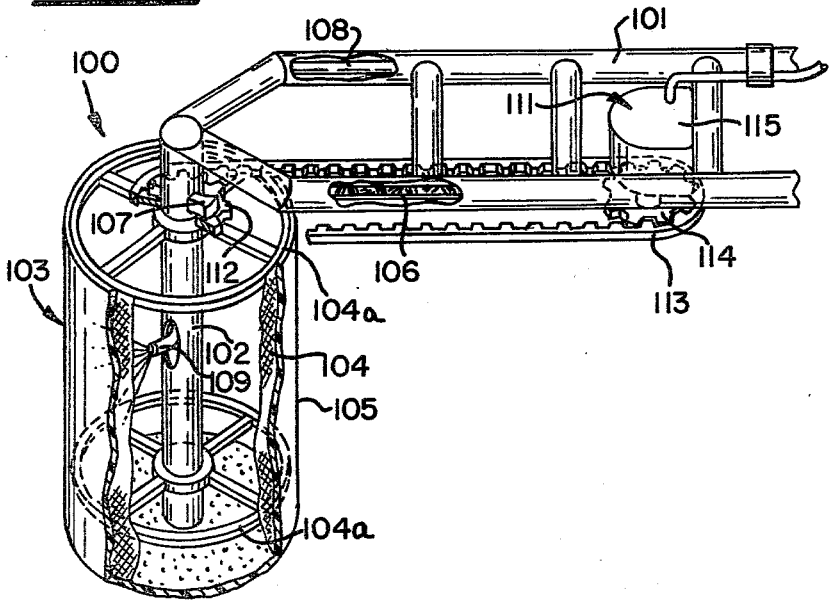

APPARATUS FOR CONTAINERLESS PORTABLE ELECTRO-POLISHING

This invention relates to the electro-chemical polishing of surfaces of relatively large metal objects utilizing new and improved apparatus and methods which are more practical, in certain circumstances, than electro-chemically polishing same by immersion in a tank of electrolytic bath.

Heretofore, the treatment of positively charged metal surfaces with an electro-polishing action has been performed either by immersing the object to be treated in a tank having a charged cathode and an electrolytic bath therein; or by fabricating a container where at least a portion of the positively charged surface of the object to be electro-polished forms one wall of the container, and then introducing an electrolytic bath and a charged cathode therein.

Examples of an immerson type electro-polishing treatment are found in my U.S. Pat. No. 3,616,341 and my allowed pending patent application, Ser. No. 829,668. Examples of the latter type of electro-polishing treatment are found in my U.S. Pat. Nos. 4,001,094 and 4,082,638. The immersion techniques work well when objects may be transported to a facility with large permanent immersion tanks therein. In certain instances, noted most specifically in my co-pending application, immersion may be used in situ with some large metal objects. As disclosed therein, a large bath container may be fabricated such that the surface of the object to be polished forms one wall thereof. Then, a relatively small moveable cathode may be mounted on the container, immersed in the electrolytic bath, charged negatively, and then moved over the positively charged surface to be treated until a proper polishing action has been obtained.

The latter type of treatment, incremental electro-chemical polishing utilizing portable bath and cathode holding containers, is practical for in-situ operation, especially with large immovable vessels or with vessels which are so large, they may require fabrication on the job site. An electrolyte and cathode holding container is formed of dielectric material so as to include at least one open end or side having a seal positioned therearound which is adapted to engage at least a portion of the vessel wall to be treated. The seal is maintained between the metal surface forming a portion of the electrolytic bath container and the remainder of the di-electric container, in order to create a wall of bath between the cathode and the surface to be treated. Such a seal has been obtained by attaching a sealing material, such as a rubber strip, to the edge of the container contacting the surface to be polished, and by the use of hydraulic cylinders to maintain the container and the object in sealing engagement.

In working with the portable chamber-type incremental electro-polishing apparatus, applicant has noted that a need has arisen for simplifying that apparatus, and the method for electro-polishing metal surfaces utilizing means. More specifically, at times needs have arisen for eliminating the necessity of sealing the apparatus to the metal surface to be treated, thereby eliminating the use of hydraulic cylinders to affect the sealing engagement. Also, a need has arisen to simplify the apparatus by providing a novel flexible structure which may be custom-fitted to the surface to be treated in a more efficient manner than utilizing the di-electric chamber as heretofore known.

The invention is directed in an apparatus for electro-polishing a surface of a metal object wherein the apparatus includes cathode means including a conductive material for conducting a negative electric charge in the apparatus, means for providing a predetermined distance between the cathode and the metal surface, means for supplying an electrolytic bath between the cathode means and the metal surface, and means for maintaining the bath between the cathode means and the metal surface. The invention resides in an improvement wherein at least a portion of the bath maintaining means comprises a liquid-retaining first di-electric member of predetermined thickness positioned between the cathode and the metal surface.

The invention is further directed to a method of electro-polishing a surface of a metal object by the following steps: positioning the surface of a cathode a predetermined distance from said surface to be electro-polished; introducing and maintaining an electrolytic bath between said cathode and said surface to be electro-polished; charging said cathode negatively; said charging said object positively; an improvement wherein the step of introducing and maintaining said electrolytic bath includes the step of: positioning a liquid-absorbing di-electric material of pre-determined thickness between said cathode and said surface to be electro-polished.

It is therefore an object of the present invention, generally stated, to provide a new, improved and simplified apparatus and method for electro-chemically polishing relatively large surfaces.

Another object of the present invention is the provision of apparatus and method for electro-chemically polishing the surface of metal objects which are containerless, immersionless and provide for quality polishing of a metal surface without sealing that surface in a liquid-tight container.

Certain more specific objects and several advantages of the present invention will become apparent from the following detailed description of presently preferred embodiments thereof taken in conjunction with the accompanying drawings, wherein:

FIG. 1 is a fragmentary perspective view of an electro-chemical polishing apparatus constructed in accordance with the present invention as it appears when mounted in a large, cylindrical, dome-ended vessel.

FIG. 1*a* is a cross-sectional view, on enlarged scale, taken on line 1*a*—1*a* of FIG. 1.

FIG. 2 is a fragmentary perspective view, similar to FIG. 1, showing an apparatus of the invention adapted for electro-chemically polishing the inner surface of the domed end of the vessel shown in FIG. 1.

FIG. 3 is a fragmentary perspective view, similar to FIG. 1, wherein the apparatus of the invention has been adapted for electro-chemically polishing a horizontal weld in the vessel shown in FIG. 1.

FIG. 3*a* is a fragmentary perspective view, similar to FIG. 1, wherein the apparatus of the invention has been adapted for electro-chemically polishing a vertical weld in the vessel shown in FIG. 1.

FIG. 4 is a fragmentary perspective view of an interior corner of a metal object wherein the apparatus of the invention has been adapted for electro-chemically polishing that corner surface.

FIG. 5 is a perspective view of one embodiment of the invention incorporating a flexible tubular frame.

FIG. 5*a* is a cross-sectional view, on enlarged scale, taken on line 5*a*—5*a* of FIG. 7.

FIG. 6 is a diagrammatic view of a portion of an embodiment of the invention, such as is shown in FIG. 5, which is adapted to bend the apparatus to the shape of the metal surface to be electro-chemically polished.

FIG. 7 is a fragmentary perspective view of another embodiment of the present invention utilizing a braided-wire cathode and having a pocket-formed sheet of di-electric material positioned on the rear of the liquid-retaining di-electric material thereof, and FIG. 8 is a fragmentary perspective view of an additional embodiment of the invention wherein the liquid-retaining di-electric material therein is formed in the shape of a roller.

Referring to FIGS. 1 and 1*a*, one embodiment of an electro-chemical polishing (or electro-polishing) apparatus constructed in accordance with the present invention, is generally indicated at 10 as it appears when adapted for treating the interior side surface of a large cylindrical dome-ended vessel, generally indicated at 11. In this embodiment, the apparatus 10 is doubled and depends from opposing sides of a central shaft 12 which is positioned vertically along the central axis of the vessel 11. Shaft 12 may form a portion of an agitator (not shown) permanently mounted in the vessel, or may be a portion of the apparatus 10 which is temporarily vertically mounted along the center line of the vessel by any conventional means. One such means is shown and described in my U.S. Pat. No. 4,082,638.

An important aspect of the portable embodiments of the invention shown and described herein resides in a sheet of porous, di-electric, liquid retaining or absorbing material 13 of pre-determined thickness, and an electrically conductive wire mesh screen 14 positioned contiguously inwardly thereof. This absorbent sheet 13 is capable of retaining electrolyte, or staying wet, and is porous to an extent allowing current and gas (formed as a result of the electro-chemical action) to pass therethrough. In this invention, the gas bubbles formed during electro-polishing are removed from the respective anode and cathode surfaces by the movement of electrolyte across those surfaces. Preferred di-electric materials are felt-like natural or synthetic materials including polymers such as polyethylene, polypropylene, polyvinyl-chloride, polyesters such as dacron, or the like. It should be noted that cotton or nylon would be destroyed by the electrolyte. In this embodiment, a conductive connecting plate 15 is fastened to the wire mesh screen 14 and provides a connection at 15*a* to an electrically conductive cable 16 which is preferably mounted to a conventional direct current electric power source 16*a*. During electro-polishing, the wire mesh screen is negatively charged as a cathode, and the vessel is positively charged as an anode. The electrolytic bath held in the sponge-like material 13 closes the electric circuit, thus creating an electro-polishing action on the inner surface of the vessel sidewall 11*a* immediately opposite the cathode 14.

The remainder of the electro-polishing apparatus 10 in this embodiment includes a cantilever type mounting frame, generally indicated at 17, which is attached to shaft 12 by a split collar 17*a* and includes horizontal arm members 18—18 extending outwardly therefrom toward the sidewall 11*a* of vessel 11. In this preferred embodiment, each arm member includes an extensible housing 19 having a coil spring 20 mounted therein for exerting an outward pressure on the vessel sidewall. It should be noted that the arm members do not have to be extensible, and are not required to exert substantial pressure on the vessel sidewall. The function of the apparatus is to maintain the liquid-retaining material 13 in direct contact with the object to be polished. The ends of the opposing pairs of arm members 18—18 are connected by upper and lower arcuate shape mounting bars 21–22which are formed of a di-electric material, have outwardly facing surfaces 21*a*, 22*a*, respectively which match the curvature of the vessel sidewall surface, and which are joined together by fasteners 23—23 to sandwich the di-electric sheet 13 and cathode screen 14 therebetween. A pair of leaf springs 25—25 extend outwardly and downwardly from arm members 18—18 against the absorbent material 13 near the bottom thereof in order to bias same against the surface to be polished.

The apparatus 10 of this embodiment further includes hose 25*b*, which is depended from the cantilever arm members 18—18 to deliver the bath to the liquid-retaining di-electric material 13. The electrolytic bath may be moved through hose 25 by conventional pump means 26. A return hose 25*a* may extend from the bottom of vessel 11, or from the bottom of a receiving tank 27 positioned under the vessel 11 to the pump in order to provide a cycle of flow through the apparatus. It should be noted that electrolytic baths are available commercially.

In operation, the wire mesh cathode 14 is given a negative direct current charge, the vessel 11 is charged positively, and electrolytic bath is sprayed through the wire mesh screen 14 onto the back of the material 13 to complete the circuit and provide an electro-polishing action on the anode. It should be noted that the spray of electrolytic bath tends to force the sponge-like material 13 and the screen 14 onto the sidewall 11*a* of the vessel 11. The predetermined thickness of the di-electric material 13 maintains the cathode 14 in a constant distance from the interior surface of the vessel sidewall 11*a*, thus providing an even electro-polishing action on the sidewall substantially directly opposite the cathode 14.

The pumping of electrolytic bath may either be continuous or intermittent, as long as the sponge-like sheet 13 and cathode 14 remain against the vessel sidewall in a wetted, circuit-closed condition. When sufficient electro-polishing action has taken place adjacent the cathode 14, the apparatus 10 may be rotated horizontally on shaft 12 until the pair of di-electric sheets 13—13 shown cover a non-polished portion of the vessel sidewall surface. A cylindrical band of the vessel sidewall is polished in this manner. Then, the frame 13, of apparatus 10, may be raised or lowered on shaft 12 to electro-polish additional cylindrical bands until the vessel interior is completely electro-polished. It should be noted that the frame 17 should be insulated from the surfaces to be polished in order to provide a closed circuit through the electrolyte.

In FIGS. 2–4 the basic embodiment of the apparatus shown in FIG. 1, has been adapted for facilitating specific electro-polishing operations. The specific operations shown are: polishing the interior surface on the top domed end of a vessel (FIG. 2); polishing a horizontal weld on a vessel wall (FIG. 3); polishing a vertical weld on a vessel wall (FIG. 3*a*); and polishing an interior corner on a metal object (FIG. 4). These adaptations have included therein certain specific features which enable the apparatus to perform a certain function very well. The function of the cathode and sponge-like di-electric sheet do not change in any of the embodiments or adaptations shown and described herein. In many of the adaptations the shape of the frame is the major change. It sould be noted that certain of these special features are interchangeable in more than one of the differing adaptations; and explaining the use of these special features for certain adaptations is not to be considered as limiting my invention in any way, but is only an example of how those features may be utilized.

Referring to FIG. 2, the apparatus, generally indicated at 30, for electropolishing the inner surface of the domed top end of vessel 11 is mounted in cantilever fashion on the central shaft 12. However, in this adaptation, the cantilever frame of the apparatus includes upper and lower dual-arm members 31 and 32, respectively, with the length of the upper members being shorter than the length of the lower members. As in the basic embodiment, arcuate shape cross members 33—33 and 34—34 extend between the ends of the bifurcated arms 31 and 32, respectively, and sandwich the upper and lower sides of a trapezoidal shape sponge-like sheet 35 therebetween. However, in this embodiment, the cathode 36 includes a plurality of spring-like fingers 36—36 which extend downwardly and outwardly from between the upper cross members 33—33 so as to apply an outward pressure to the sponge-like sheet 35 in order to maintain same against the inner surface of the vessel domed end. The fingers 36—36 are made of an electrically conductive material such as a copper alloy and are connected to a source of a direct current negative charge by cable 37. A hose 38 includes a multiple nozzle end cap 40 which directs electrolytic bath onto the liquid retaining di-electric material 35 in the same manner as described above. Also, operation of the apparatus 30 is substantially similar to the operation of apparatus 10 described above.

Referring to FIGS. 3 and 3*a*, rectangular framed electro-polishing apparatuses, generally indicated at 41 and 42, are similar in construction, but extend from the central shaft 12 in horizontal and vertical orientations, respectively, for polishing horizontal and vertical weld junctures in a vessel sidewall. Apparatus 41 includes a pyramidal type frame 43 including a split collar 44 at its apex which mounts to the central shaft 12, and a generally rectangular but arcuately formed base 45 which is positioned adjacent the vessel sidewall 11. A sheet of liquid-retaining di-electric material 46 is mounted across the back of the frame base. However, in this embodiment, the wire mesh has been replaced by a cathode forming a bifurcated nozzle 47 on hose 48 which is connected to a D.C. power source through cable 49. A closed circuit is maintained between the cathode and anode as long as the stream of electrolyte is continuous. The bifurcated stream spreads electrolyte more evenly across the back of the absorbent material 13 and provides two circuit closing current paths. In this embodiment, the long side of the di-electric sheet runs parallel with the weld to be polished.

Referring to FIG. 3*a*, apparatus 42 also includes a hollow pyramidal type frame 50 which is attached at its apex to the shaft 12 by a keyed split collar 51. It should be noted that a key 12*a* has been added to shaft 12 in order to align the apparatus 42 for vertical movement along the shaft without misaligning same relative the vertical weld to be polished. The frame 50 also includes a rectangular base 52 which has a sheet of wire mesh backed liquid-retaining di-electric material 53 mounted across the outward facing side thereof with the screen connected by cable 54 to a suitable direct current power source (not shown). A hose 55 and pump (not shown) supply electrolytic bath to the back side of the di-electric sheet 53. Operation of these adaptations are similar to that for the basic embodiment disclosed.

It should be noted that the apparatuses shown in FIGS. 3 and 3*a* may be utilized with the apparatus and method disclosed in my pending U.S. patent application Ser. No. 829,668 to electro-polish very large vessels in situ during erection of same. The large slightly curved metal panels may be electro-polished prior to being welded together to form the vessel sidewall as disclosed in the aforementioned patent application. After the sidewall panels have been welded together, the welds may be ground flush and the weld surface area electro-polished utilizing the apparatuses of FIGS. 3 and 3*a* to obtain a continuous mirror-finish surface of the entire interior of the vessel.

Referring to FIG. 4, another adaptation of the basic embodiment of the invention is shown polishing an interior corner of a metal object. The apparatus, generally indicated at 60, includes a hollow box-shaped frame 61 having a wire mesh backed sheet of di-electric material 62 extended over two adjacent sides thereof, with the screen connected by cable 63 to a suitable D.C. power source. Electrolytic bath is pumped through hose 64 onto the back of the di-electric sheet 62 as previously disclosed. Further, in this adaptation a plurality of chevron-type troughs or louvers 65—65 are mounted on frame 61 across the back surface of the di-electric sheet 62 such that when electrolytic bath is sprayed onto the sheet 62, it collects between the louvers and the sheet and maintains the sheet in a wet, current-carrying condition for an extended period. The ability to spray bath intermittantly is enhanced by the use of louvers 65.

Referring to FIGS. 5, 5*a* and 6, the flexibility of the liquid-retaining di-electric sheet materials in the polishing apparatus may be used to great advantage for polishing both regular and irregular curved surfaces of metal objects with the addition of a flexible frame thereto. Further, if the frame is tubular, it may also provide the conduit means for the electrolytic bath. Such an apparatus, generally indicated at 70 in FIG. 5, includes a generally rectangular flexible tubular frame 71 which is fed through an opening 72, which is connected to a suitable pumping-reservoir arrangement as disclosed previously. One pair of opposing parallel sides on rectangular frame 71 include a plurality of spray nozzles 74 positioned preferably at regularly spaced intervals therealong. The nozzles direct the bath against the back of the wire mesh 76 backed sheet of liquid-retaining di-electric material 75 stretched between and partially around those opposing parallel sides of the tubular frame 71, with the mesh screen connected by cable 71 to a negatively charge D.C. power source.

As shown most clearly in FIG. 5*a*, when electrolytic bath is pumped through the frame 71 and sprayed through nozzles 74 onto the liquid-retaining sheet 74 after the screen is negatively charged and the metal object to be polished is positively charged, an effective electro-polishing action can be maintained on the surface of the metal object.

Referring to FIG. 6, the apparatus as disclosed in FIGS. 5 and 5*a* may be made to conform to any regularly or irregularly curved metal surface, such as shown at 80 by the use of a multiple leaf-spring pressure device, generally indicated at 81. The pressure device 81 is constructed in pyramid form so that when pressure is applied at one central point 82, that pressure is substantially evenly distributed over the pyramid leaf-springs therein to a multitude of pressure points which, in this embodiment, extend substantially across the mesh backed di-electric sheet 83 to bend the sheet to the shape of the metal surface 80. Apparatus 81 includes a central large arcuately bent leaf-spring 84 having pivotal mounting 85—85 at its opposed ends. The pivotal mountings are connected to the centers of a pair of arcuate shaped leaf springs 86—86 (second tier) which are again connected at their opposed ends to the center of additional pairs of leaf-springs 87—87 (third tier). At the ends of the last arcuate leaf springs 87—87, are mounted pressure plates 90—90 which apply the distributed pressure to the flexible sheet 83 to maintain same against the curved metal surface 80. With the sheet conformed to the metal surface to be polished, an electro-polishing action may be maintained thereon.

Referring to FIG. 7, a pocket-type electro-polishing apparatus, generally indicated at 91, further includes an additional sheet of di-electric material 92 (preferably liquid impervious) mounted on the back of the liquid-retaining di-electric sheet 93 to prevent the escape of electrolytic bath through the back of the apparatus. Also, this embodiment includes a plurality of parallel, flat-braided cable strands 95—95 mounted in spaced relation across the back of the di-electric sheet 92 as an alternative to the wire mesh screen previously disclosed. The liquid impervious sheet 92 includes a plurality of long tubular or pocket portions 94—94 positioned between and parallel to each length of braided cable strands 95. A hose 96 for moving the electrolytic bath is connected to a manifold 97 with a plurality of gates or nozzles 98—98 which direct the bath into the tubular pockets 94. While it is preferable that the bottom of the pockets 94 be closed, or at least partly closed, and that the second di-electric sheet 92 be wrapped around the side edges of the first di-electric sheet 93, no conscious effort is made to seal the apparatus to the object to be polished, as disclosed in my prior U.S. Pat. Nos. 4,001,094; and 4,082,638. It should be noted that as one inhibits the bath from exiting the rear or sides of the sponge-like sheet 93, there is a greater tendency for the bath to push the apparatus away from the surface to be polished.

The apparatus 91 shown in FIG. 7 can be adapted for moving by hand as long as the di-electric material 92 is liquid impervious and electrically insulated. The apparatus 91 is more easily made hand movable if the upper end thereof, including the manifold 97 and the tops of the pockets 94—94 are enclosed. It should be noted that the electric current providing the electro-polishing action is low voltage and would not produce a deleterious effect to an operator moving the apparatus 91, especially onto a horizontal metal surface.

In FIG. 8, a portable roller-type electro-polishing apparatus, indicated generally at 100, includes a bifurcated frame or handle 101 terminating in an axle member 102 having a hollow cylindrical roller, generally indicated at 103, rotatably mounted thereon. Cylindrical roller 103 includes a hollow frame 104, which in this embodiment, is a wire mesh screen having a journaled hub **104*a* at each end thereof. However, it can be appreciated that the cylindrical frame may be made of other suitable materials. A sheet of liquid-retaining di-electric material 105 is mounted over the frame 104, and an electrically conductive cable 106, attached at one end to a source of direct current negative charge, is fed through frame 101 into axle 102 and attached at its opposite end by brushes 107 to the frame 104 in sliding or pivotal relation therewith. A hose 108 is connected at one end to a pumping apparatus and electrolyte reservoir as disclosed in previous embodiments, fed through frame 101 into axle 102 and is directed at its opposing end to the interior of the roller 103 by a nozzle 109. With a suitable negative D.C. charge given to the cathode 104, the electrolytic bath sprayed onto the interior surface of di-electric sheet 105, and a suitable positive D.C. charge given to the object to the electro-polished (not shown), the portable apparatus 100 may be utilized to electro-polish any suitable metal surface. In order to assure the rotation of the roller on the surface to be polished, preferably an air driven mechanism, generally indicated at 111, rotates the roller by driving a cog pulley 112 on axle 102 through belt 113 and cog pinion 114 attached to an air powered motor 115**.

While several embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

I claim:

1. In apparatus for electro-polishing relatively large surface areas having substantially uniform configuration, the improvement comprising, a cathode support frame having cathode support portions conforming substantially to said configuration, a permeable electrolyte-retaining blanket of uniform thickness and formed of dielectric material mounted on said frame by attachment to said conforming cathode support portions with an exposed outer surface facing outwardly from said frame for engagement with said surface areas and the opposite inner surface thereof facing inwardly, foraminous cathode means mounted on said frame by attachment to said conforming cathode support portions and in engagement with said inner surface of said blanket and spaced by said blanket a uniform distance from said surface areas, and spray means for supplying electrolyte to said inner surface of said blanket.

2. The improvement called for in claim 1 wherein said spray means sprays electrolyte against said foraminous cathode and the force of the sprays assists in maintaining engagement between said surface areas to be polished and said outer surface of said blanket.

3. The apparatus as defined in claim 1 wherein said blanket is a felt-like natural material.

4. The apparatus as defined in claim 1 wherein said blanket is a synthetic fibrous material.

5. The apparatus as defined in claim 1 wherein said cathode support frame includes means for biasing said blanket against said surface of said metal object.

6. The apparatus as defined in claim 5 wherein said biasing means includes said cathode means.

7. The apparatus as defined in claim 1 wherein said frame includes louver-type surfaces extending at least partly across the inner surface of said blanket.

8. The apparatus as defined in claim 1 wherein said cathode means include a braided copper cable.

9. The apparatus as defined in claim 1 wherein an impermeable dielectric member is positioned behind said blanket so as to sandwich said foraminous cathode means therebetween.

10. The apparatus as defined in claim 9 wherein said impermeable dielectric member has liquid receiving pockets.

11. The apparatus as defined in claim 1 wherein said cathode support frame is in the form of a rotatably mounted hollow cylinder.

12. The apparatus as defined in claim 1 wherein said cathode support frame is at least partially flexible.

13. The apparatus as defined in claim 12 wherein said frame includes a tubular member adapted to be at least a portion of said electrolytic bath supplying means.

14. An apparatus for electro-polishing a surface of a metal object, said apparatus comprising: a sheet of flexible liquid-retaining di-electric material of pre-determined thickness for retaining electrolytic bath; a cathode member maintained across a back surface of said sheet of di-electric material, said cathode member covering less than the entire back surface of said sheet and including spaces between portions of said member for movement of electrolytic bath and reaction-produced gases therethrough; frame means upon which said sheet and said cathode member are mounted for positioning a front surface of said sheet against said surface of said metal object to be polished a source of direct current for negatively charging said cathode member and positively charging said surface to be electro-polished; and electrolytic bath movement means including a pump, first conduit means in communication with said pump for moving electrolytic bath to said sheet of liquid-retaining di-electric material, and second conduit means in communication with said pump for collecting electrolytic bath after same has exited said sheet.

* * * * *